US006663519B2

(12) United States Patent
Kuhn et al.

(10) Patent No.: US 6,663,519 B2
(45) Date of Patent: Dec. 16, 2003

(54) PROPRIOCEPTIVE PITCH TRAINER BASEBALL

(76) Inventors: Timothy Kuhn, 9566 Black Bear Dr., Reno, NV (US) 89506; David Ishii, 631 N. Norwood Dr., San Dimas, CA (US) 91773

( * ) Notice: Subject to any disclaimer, the term of this patent is extended or adjusted under 35 U.S.C. 154(b) by 0 days.

(21) Appl. No.: 10/171,529

(22) Filed: Jun. 11, 2002

(65) Prior Publication Data

US 2003/0027671 A1 Feb. 6, 2003

Related U.S. Application Data

(60) Provisional application No. 60/297,713, filed on Jun. 12, 2001.

(51) Int. Cl.[7] ..... A63B 37/12
(52) U.S. Cl. ..... 473/597; 473/600; 473/458
(58) Field of Search ..... 473/596, 597, 473/600, 451, 598, 458; D21/713

(56) References Cited

U.S. PATENT DOCUMENTS 2,925,273 A 2/1960 Pratt
3,110,494 A * 11/1963 Morgan ..... 473/458
4,318,544 A * 3/1982 Brine, Jr. ..... 473/596
5,407,193 A * 4/1995 McGinley ..... 473/451
5,772,544 A * 6/1998 Yang ..... 473/598
5,893,808 A * 4/1999 Bennett ..... 473/451
6,520,877 B1 * 2/2003 Yang ..... 473/604

* cited by examiner

*Primary Examiner*—Steven Wong
(74) *Attorney, Agent, or Firm*—Knobbe Martens Olson & Bear LLP

(57) ABSTRACT

A baseball pitching training device providing students of pitching with one or more tactile surfaces, preferably on the seam, thus providing the with tactile input for development of the students proprioceptive senses. In addition, finger placement indicia may be provided, preferably on the cover of the baseball, to indicate a proper finger placement orientation for one or more baseball pitches. The tactile surface(s) and finger placement indicia provide tactile stimuli and instruction for several different types of pitches for either right handed or left handed students.

18 Claims, 10 Drawing Sheets

PROPRIOCEPTIVE PITCH TRAINER BASEBALL

PRIORITY INFORMATION

This application claims priority to U.S. Provisional Patent Application No. 60/297,713, filed Jun. 12, 2001, the entirety of which is incorporated by reference herein.

BACKGROUND OF THE INVENTION

1. Field of the Invention

The present invention relates to the field of sports training and, more particularly, to an improved baseball pitching training device for use in reproducing the specific finger placement and grasp of the baseball.

2. Description of the Related Art

The act of pitching a baseball is comprised of a number of separate steps including the wind-up, the cocking phase, the acceleration phase, the release of the baseball, and the declaration/follow-through phase. All of these steps are directed towards the development of acceleration of the baseball towards the catcher and the development of a desired motion for the trajectory of the baseball.

However, while students of baseball can observe the mechanics of these bodily motions it is difficult, if not impossible, to observe the particular grasp of the baseball utilized by a pitcher during the course of his pitching. During a pitch, the baseball is covered by both the baseball glove as well as the pitcher's hand while moving rapidly. This makes it difficult to observe particular finger placement by the pitcher and the finger from which the ball leaves the hand. The high velocity also makes it all but impossible to observe the release of the baseball with each pitch and the specific effect on rotation that these components produce. Drawings of the grasping or release of a baseball are insufficient for effectively communicating the actual placement of the fingers on the ball and describing the manner of the overall grip and release.

SUMMARY OF THE INVENTION

In light of above, it is desirable to provide an improved training baseball. In a preferred embodiment, the baseball provides a pitcher with tactile stimulation such that he or she may determine how the baseball leaves the hand. Such an arrangement assists in developing the proper grip and release of the baseball during pitching.

Desirably, in addition to providing tactile stimulation, a preferred embodiment provides an indication of the finger placement of key fingers for several pitches, which may be duplicated by the student. Of course, not all of the above-mentioned goals may be achieved in a single preferred embodiment. That is, some goals may be exemplified in one embodiment while other goals are exemplified in other embodiments.

Advantageously, the tactile surfaces on the preferred baseball pitching device provides tactile stimulation to the student, which will enhance the student's awareness/proprioception for grip and release of the baseball when performing specific pitches. In one embodiment, the training device comprises a baseball having at least one tactile surface, which preferably is constructed of four groups of enlarged stitches, located in strategic positions along the stitching of the baseball. Preferably, the three stitches are enlarged in each grouping with 100% cotton jewelry cord, such as DARICE brand jewelry cord and correspond to the placement of key fingers for specific pitches. Desirably, a preferred embodiment is configured for use by one of a right handed and left handed student, however, in some arrangements the baseball may be configured for use by both right handed and left handed students.

In one embodiment, a first set of markings, or indicia, correspond to one or more tactile surfaces and indicate the proper placement of the key fingers for throwing a slider pitch. Preferably, a second set of indicia indicate the placement of the key fingers for throwing a curve ball pitch, a third set of indicia indicate the placement of the key fingers for throwing a four-seam fast ball and a fourth set of indicia indicate the placement of the key finger for throwing a circle change pitch. To distinguish between the tactile surfaces for the different pitches, the indicia may be color coded such that each color represents a different pitch. To further help the student orient the ball within the hand, the indicia on the cover may be positioned so as to indicate the direction that the key finger(s) are to point.

One preferred embodiment is a training device comprised of a baseball having a protruding tactile surface on the surface of the baseball. The tactile surface provides a location for finger placement and provides a user of the baseball with tactile stimulation upon release of the baseball during a pitch.

Another preferred embodiment is a training device comprised of a baseball defining an outer surface and a seam. The seam extends at least partially around the baseball. The baseball has a plurality of stitches extending across the seam. A plurality of tactile surfaces are raised above the outer surface of the baseball. The tactile surfaces are configured to provide tactile stimulation to a user when grasping one or more of the plurality of tactile surfaces. The plurality of tactile surfaces are disposed on at least a portion of the plurality of stitches. A plurality of finger placement indicia are provided on the outer surface of the baseball. The indicia are associated with the tactile surfaces and are configured to indicate a finger placement orientation on one or more of said tactile surfaces relative to the baseball for at least four different types of baseball pitches.

Yet another preferred embodiment is a training device comprised of a baseball defining an outer surface including a seam. The seam extends at least partially around the baseball. The baseball has a plurality of stitches extending across the seam. At least two tactile surfaces are provided and are raised above the outer surface of the baseball. The tactile surfaces are configured to provide a user with tactile stimulation when the user grasps one or more of the tactile surfaces. Each of said tactile surfaces are sized and shaped to generally conform to a fingertip of a user

BRIEF DESCRIPTION OF THE DRAWINGS

These and other features, aspects and advantages of the present invention are described in greater detail below with reference to the drawings, which are intended to illustrate, but not to limit, the present invention. The drawings comprise ten figures.

DETAILED DESCRIPTION OF THE PREFERRED EMBODIMENT

Figure 1:
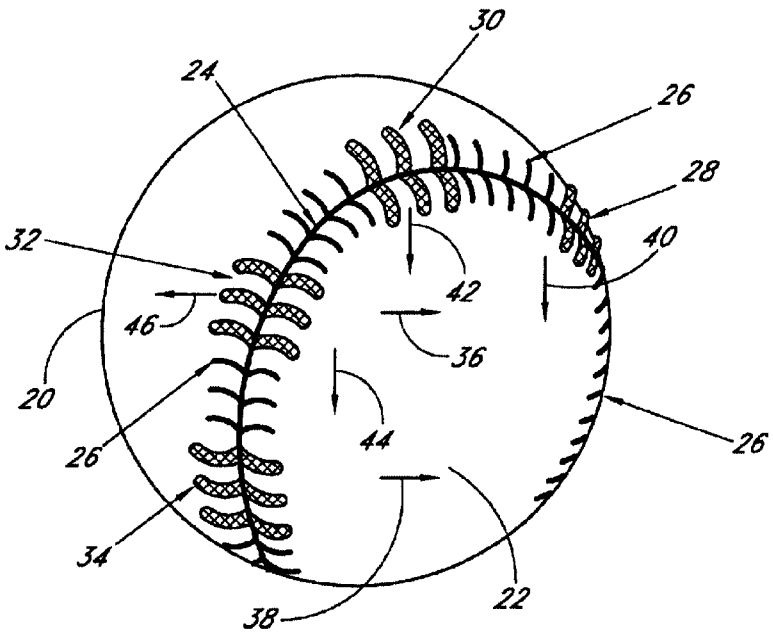
FIG. 1 is a perspective view of a preferred baseball illustrating the tactile surfaces on the seams, as well as finger placement indicia on the cover of the baseball for assisting right handed persons in orientating the baseball for throwing various baseball pitches, preferably including a four-seam fast ball, a slider, curve ball, and a circle change up.
Figure 6:
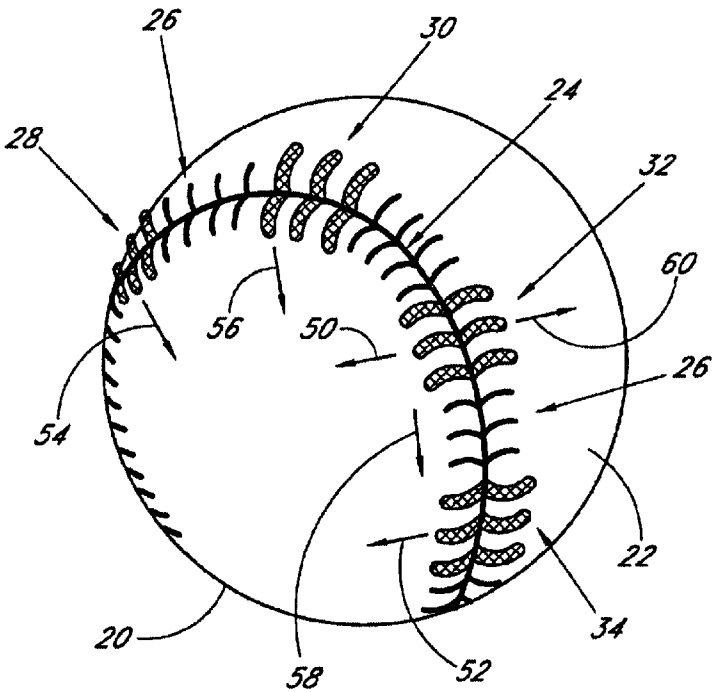
FIG. 6 is a perspective view of a modification of the baseball of FIG. 1. The baseball of FIG. 6 also includes tactile surfaces on the seams, as well as finger placement indicia on the cover of the baseball, which are modified to indicate correct finger placement for left handed pitchers.

With reference to FIG. 1 (right handed ball) and FIG. 6 (left handed ball), a regulation baseball 20 is shown having a seam 24 of a cover 22 closed and held together by stitching 26. In addition, preferably the baseball 20 includes four groups of modified stitches 28, 30, 32, 34. Each group of modified stitching desirably includes three modified stitches, however, other suitable number of modified stitches may also be used to define the tactile stimulation surfaces. Preferably, the baseball 20 is of a typical baseball construction with the exception of the modified groupings of stitching and, desirably, provides the general look, action, and characteristics of the regulation baseball as it is pitched. Advantageously, the groups of modified stitching 28, 30, 32, 34 provides a tactile stimulation surface to increase tactile stimulation to the key fingers when pitching the baseball 20 and, especially, when the ball 20 is released.

It is preferred that the baseball 20 of the illustrated embodiment maintains the general characteristics of a regulation baseball in terms of size and weight. In addition, it is preferred that the stitching 26 of the seams 24 (i.e., the stitching other than the modified groups of stitching 28, 30, 32, 34) is conventional baseball stitching, such that the baseball 20 generally reacts in the fashion of a regulation baseball while providing the user with tactile input, which advantageously encourages proper release.

Desirably, the tactile surfaces defined by the modified stitches 28, 30, 32, 34 are raised above the surface of the baseball and, preferably, above the upper surfaces of the regular stitching 26. Although the illustrated tactile surfaces are provided by modified stitching, other suitable tactile surfaces may also be provided. For example, the tactile surfaces may comprise raised bumps, stitching, protrusions, and the like. Alternatively, the tactile surfaces can be recessed surfaces, such as indentations in the baseball 20. Optionally, the tactile surfaces may have a roughened texture to increase tactile stimulation.

Desirably, as described above, the tactile surfaces are located on the seam 24 of the baseball 20. Preferably, the baseball 20 has a modified seam 24 construction, wherein the modified groups of stitching 28, 30, 32, 34 are enlarged to approximately twice the diameter of the normal stitching 26 such that tactile stimulation surfaces are defined by the enlarged seams. In addition, the modified stitching 28, 30, 32, 34 may comprise a material other than conventional baseball stitching material in order to provide a distinct difference in the feel of the modified stitching 28, 30, 32, 34, in addition to their increased size.

As will be appreciated by one of skill in the art, the number of tactile surfaces may be modified depending on the types of pitches that the baseball 20 is intended to teach. For example, a baseball 20 may be constructed to teach a single pitch and only one or two tactile surfaces may be provided. Preferably, four tactile surfaces 28, 30, 32, 34 are provided and are arranged along the seam 24 in a manner to allow a user to properly position his or her key fingers on the baseball 20 for at least four important pitches, as described in greater detail below. However, in another arrangement, the baseball 20 may include more than four tactile surfaces arranged in a manner suitable for teaching a wide variety of pitches to both right and left handed students. In addition, the tactile surfaces can be located in other positions relative to the seam 24 the baseball 20 (e.g., spaced from the seam 24 and stitches 24), depending on the types of pitches desired to be taught. Furthermore, the tactile surfaces can have various shapes and sizes suitable to provide tactile stimulation to a user of the baseball 20. Preferably, the shape and size are similar to the shape and size of a fingertip of the user.

Advantageously, the tactile surfaces defined by the modified stitches 28, 30, 32, 34 provide enhanced tactile stimulation to a user of the baseball 20 in order to decrease the amount of time necessary to learn a specific baseball pitch by utilizing the principles of proprioception. In one exemplary definition, from Taber's Cyclopedic Medical Dictionary, proprioception is defined at the awareness of posture, movement, and changes in equilibrium and the knowledge of position, weight, and resistance of objects in relation to the body. Proprioceptive Sense may be defined as the correlation of unconscious sensations from the skin and joints that allows conscious appreciation of the position of the body. These definitions are merely provided for assistance to the reader and is not intended to limited the scope of the present invention.

Following the principles of proprioception, when specific biomechanical motions are desired, the provision of tactile cues will enhance the subjects awareness of their bodies position in space (i.e. proprioception). When one observes any high level sport, examples of athletes attempting to develop the mind-muscle link (proprioception) can be observed. The batter in the on-deck circle, swings the weighted bat to make the motion feel natural/automatic to him. When the tennis player misses a shot and goes through the motion of hitting the same shot again and again, they are trying to correct their biomechanical mistake and to make the correct motion automatic. In physical therapy when dealing with a stroke patient, therapists must correct biomechanical mistakes to optimize the healing process and maximize functionality. They use tactile cues (hands on the patient) to guide them to use normal mechanics.

Tactile cues can be anything that is perceived by the subject's sense of touch and act to correct/perfect a desired motion/posture. Examples of tactile cues could be raised areas on an apparatus, different materials, rough areas, sharp/dull areas, hot/cold areas, areas that vibrate, and the like. The possibilities are wide, but one characteristic that they share is that they all apply to the subject's sense of touch and they serve the purpose of promoting a desired biomechanical motion/posture.

When learning to pitch a baseball, a player may have difficulty learning the finger position and "release" necessary to throw a pitch, such as a slider, for example. As is known, throwing certain baseball pitches requires imparting a specific rotational motion onto the ball as it is released. When learning with a regulation baseball (i.e., one without tactile cues), a player may have difficulty achieving the proper release to throw the desired pitch. For example, when learning to throw a slider, a common impediment is that the player often circumducts his fingers around the ball rather than "ripping" down through the ball with his dominant fingers.

When using the baseball 20 having tactile stimulation surfaces, the player is better able to concentrate on "ripping" down through one or more of the modified groups of stitching 28, 30, 32, 34 (i.e., the tactile cues, preferably substantially as described above) on which his dominant fingers were placed. Within only a few pitches, the player will likely be able to throw a slider with the correct mechanics, due to the heightened "feel" for the proper release provided by the tactile cues.

When subsequently given a regular baseball, the player is likely to throw it with proper mechanics. This is because the player can feel how the pitch was supposed to be thrown with the proprioceptive baseball 20, and can then replicate the release with a regular baseball.

The preferred baseball 20 shows the pitcher how to hold the ball for various pitches and gives tactile input allowing the pitcher to "feel how you are supposed to pitch." In addition, the pitch trainer provides carry-over when the player uses a regulation ball, thus allowing the player to replicate the pitch with the regulation baseball.

Proper finger placements for four important baseball pitches are described below with reference to both the right handed baseball 20 of FIG. 1 and the left handed baseball 20 of FIG. 6. As described above, these pitches are merely exemplary and the baseball 20 may be configured to provide tactile surfaces for the finger placements of other types of pitches. In addition, although two different baseballs 20 are illustrated for right and left handed students, a single baseball 20 may be provided to accommodate both right and left handed pitchers.

Right Handed Ball

1. Right Handed Fast Ball

Figure 2A:
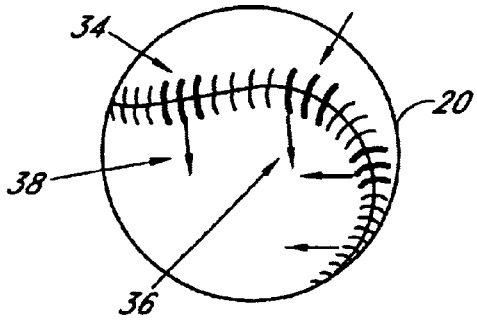
FIG. 2 illustrates the baseball of FIG. 1 being grasped in the hand of a pitcher for the throwing of a four-seam fast ball pitch by a right-handed student of pitching.
Figure 2B:
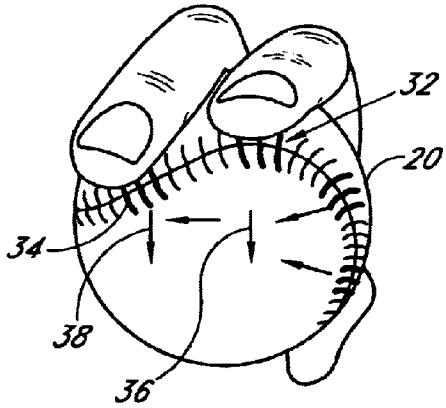
Figure 2C:
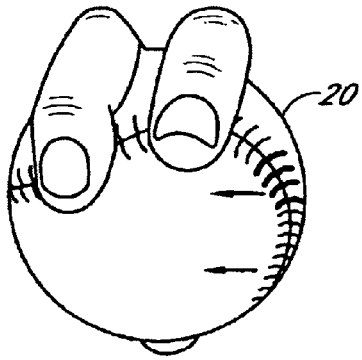

With reference to FIG. 1 and FIG. 2, tactile surfaces 32 and 34 and the corresponding finger placement indicia 36, 38, respectively, are provided for the throwing of a fast ball pitch by a right handed pitcher. In the following description, the finger placement indicia comprise arrow-shaped markings on the cover 22 of the baseball 20. In other arrangements, however, any suitable method for indicating the desired finger orientation may be used. In addition, desirably, the indicia are color-coded to represent the specific indicia to be used for different pitches.

When a right handed pitcher desires to utilize the baseball 20 for learning to throw a four-seam fast ball, the index finger of the right hand is placed on tactile surface 32 in the direction of the arrow 36 and the middle finger of the right hand is placed on tactile surface 34 in the direction of the arrow 38. The thumb then grasps the ball 20 at a position opposite tactile surfaces 32, 34 so as to securely hold the ball 20 in the right hand.

2. Right Handed Slider

Figure 3A:
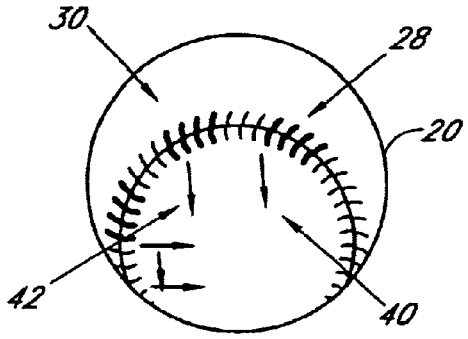
FIG. 3 illustrates the baseball of FIG. 1 being grasped in the hand of a pitcher for the throwing of a slider pitch by a right-handed student of pitching.
Figure 3B:
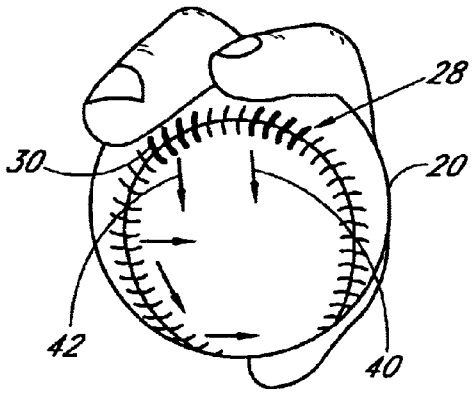
Figure 3C:
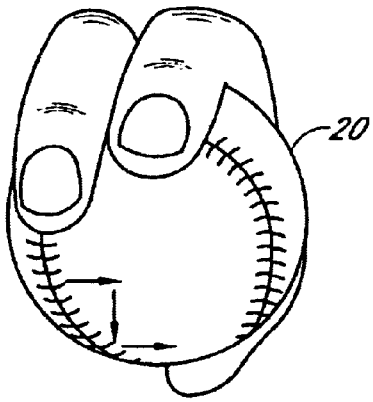

With reference to FIG. 1 and FIG. 3, tactile surface 28 and 30 and the corresponding arrows 40, 42 are provided for the throwing of a slider pitch by a right handed pitcher. When a right handed pitcher desires to utilize the baseball 20 for learning to throw a slider, the index finger of the right hand is placed on tactile surface 28 in the direction of the arrow 40 and the middle finger of the right hand is placed on tactile surface 30 in the direction of the arrow 42. The thumb then grasps the ball 20 at a position opposite tactile surfaces 28, 30 so as to securely hold the ball 20 in the right hand.

3. Right Handed Curve

Figure 4A:
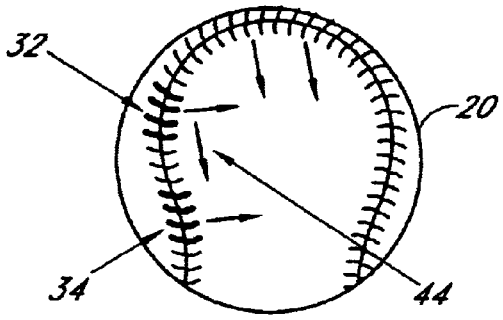
FIG. 4 illustrates the baseball of FIG. 1 being grasped in the hand of a pitcher for the throwing of a curve ball pitch by a right-handed student of pitching.
Figure 4B:
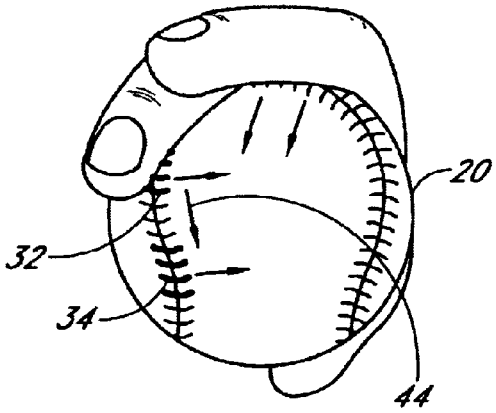
Figure 4C:
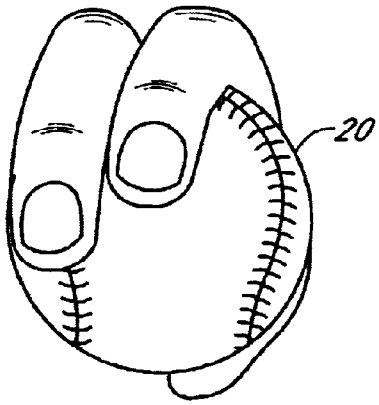

With reference to FIG. 1 and FIG. 4, tactile surfaces 32 and 34 and the corresponding arrow 44 are provided for the throwing of a curve ball pitch by a right handed pitcher. When a right handed pitcher desires to utilize the baseball 20 for learning to throw a curve ball, the medial side of the middle finger of the right hand is placed against the tactile surfaces 32, 34 in the direction of the arrow 44. The thumb then grasps the ball 20 at a position opposite tactile surface 32, 34 so as to securely hold the ball 20 in the right hand.

4. Right Handed Circle Change

Figure 5A:
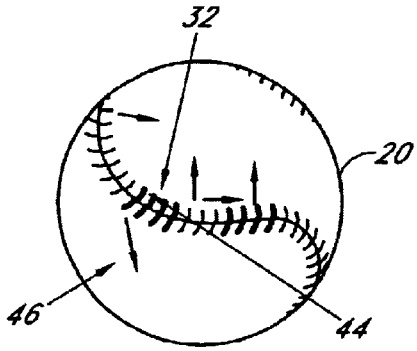
FIG. 5 illustrates the baseball of FIG. 1 being grasped in the hand of a pitcher for the throwing of a circle change up pitch by a right-handed student of pitching.
Figure 5B:
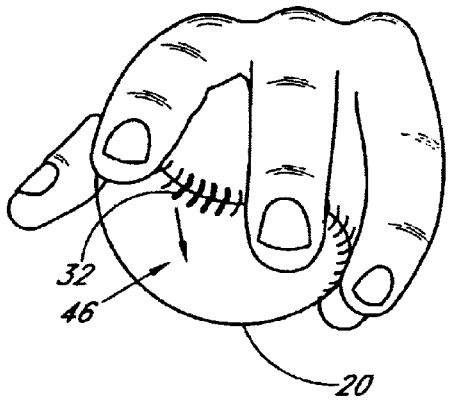
Figure 5C:
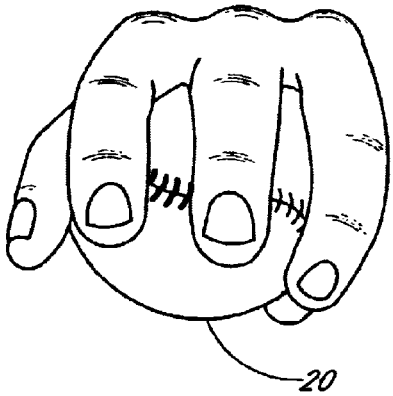

With reference to FIG. 1 and FIG. 5, tactile surface 32 and the corresponding arrow 46 are provided for the throwing of a circle change up pitch by a right handed pitcher. When a right handed pitcher desires to utilize the baseball 20 for learning to throw a circle change up, the ring finger of the right hand is placed on tactile surface 32 in the direction of the arrow 46. The fingertips of the thumb and index finger then meet so as to securely hold the ball 20 in the right hand.

Left Handed Ball

1. Left Handed Fast Ball

Figure 7A:
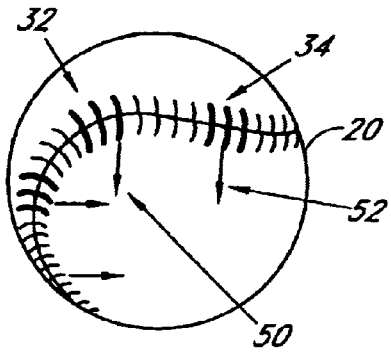
FIG. 7 illustrates the baseball of FIG. 6 being grasped in the hand of a pitcher for the throwing of a four-seam fast ball pitch by a left handed student of pitching.
Figure 7B:
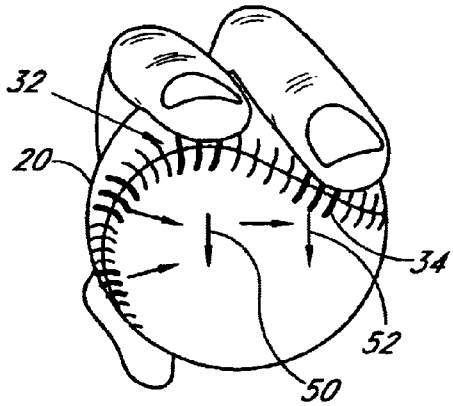
Figure 7C:
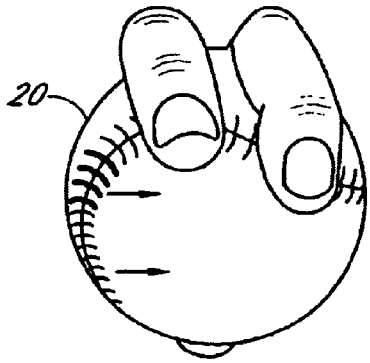

With reference to FIG. 6 and FIG. 7, tactile surfaces 32 and 34 and the corresponding arrows 50, 52 are provided for the throwing of a four-seam fast ball pitch by a left handed pitcher. When a left handed pitcher desires to utilize the baseball 20 for learning to throw a four-seam fast ball, the index finger of the left hand is placed on tactile surface 32 in the direction of the arrow 50 and the middle finger of the left hand is placed on tactile surface 34 in the direction of the arrow 52. The thumb then grasps the ball 20 at a position opposite tactile surfaces 32, 34 so as to securely hold the ball 20 in the left hand.

2. Left Handed Slider

Figure 8A:
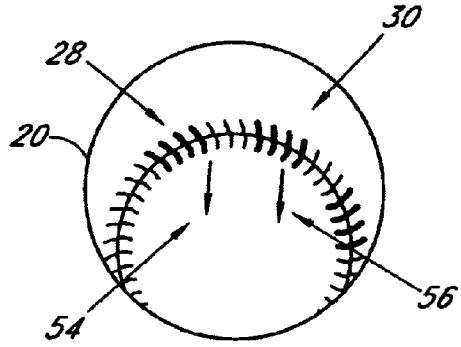
FIG. 8 illustrates the baseball of FIG. 6 being grasped in the hand of a pitcher for the throwing of a slider pitch by a left-handed student of pitching.
Figure 8B:
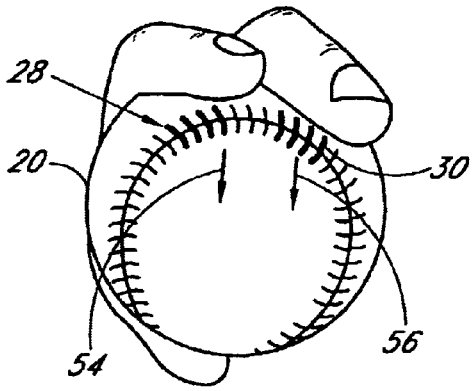
Figure 8C:
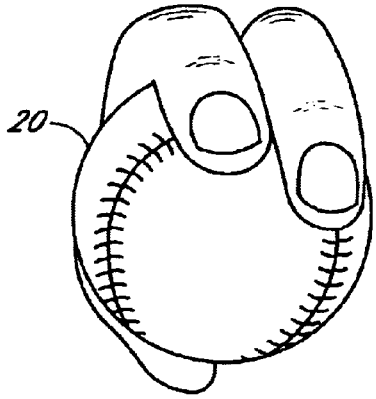

With reference to FIG. 6 and FIG. 8, tactile surfaces 28 and 30 and the corresponding arrows 54, 56 are provided for the throwing of a slider pitch by a left handed pitcher. When a left handed pitcher desires to utilize the baseball 20 for learning to throw a slider, the index finger of the left hand is placed on tactile surface 28 in the direction of the arrow 54 and the middle finger of the left hand is placed on tactile surface 30 in the direction of the arrow 56. The thumb then grasps the ball 20 at a position opposite tactile surfaces 28, 30 so as to securely hold the ball 20 in the left hand.

3. Left Handed Curve Ball

Figure 9A:
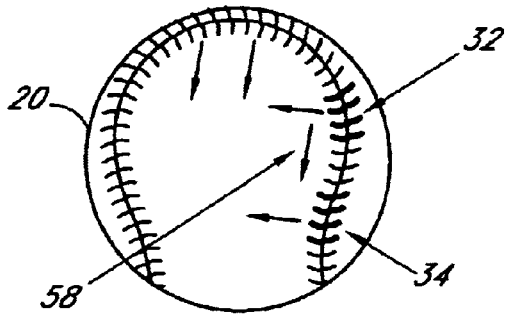
FIG. 9 illustrates the baseball of FIG. 6 being grasped in the hand of a pitcher for the throwing of a curve ball pitch by a left-handed student of pitching.
Figure 9B:
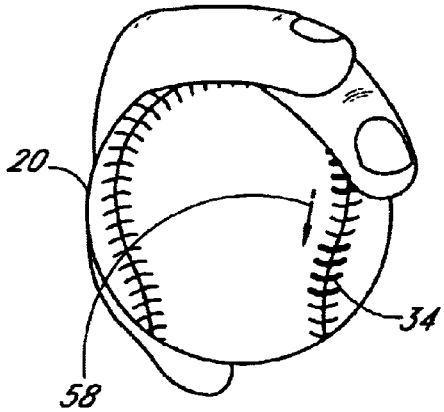
Figure 9C:
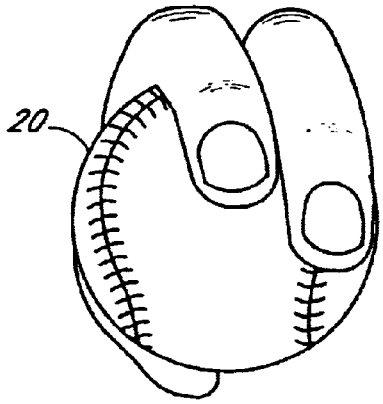

With reference to FIG. 6 and FIG. 9, tactile surfaces 32 and 34 and the corresponding arrow 58 are provided for the throwing of a curve ball pitch by a left handed pitcher. When a left handed pitcher desires to utilize the baseball 20 for learning to throw a curve ball, medial side of the middle finger of the left hand is placed against the tactile surfaces 32, 34 in the direction of the arrow 58. The thumb then grasps the ball 20 at a position opposite tactile surfaces 32, 34 so as to securely hold the ball 20 in the left hand.

4. Left Handed Circle Change

Figure 10A:
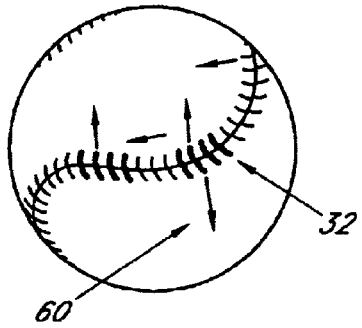
FIG. 10 illustrates the baseball of FIG. 6 being grasped in the hand of a pitcher for the throwing of a circle change up pitch by a left-handed student of pitching.
Figure 10B:
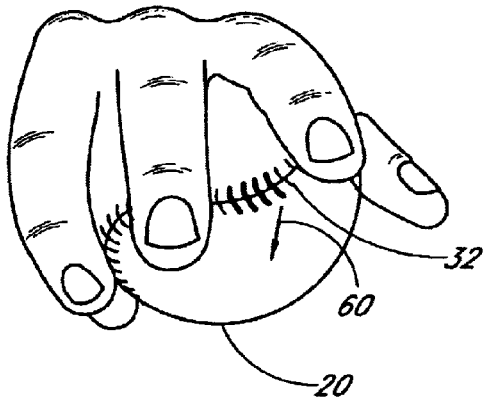
Figure 10C:
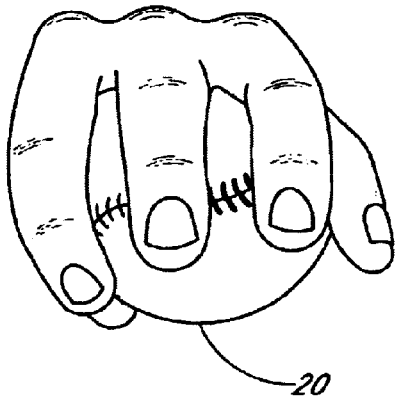

With reference to FIG. 6 and FIG. 10, tactile surface 32 and the corresponding arrow 60 are provided for the throwing of a circle change up pitch by a left handed pitcher. When a left handed pitcher desires to utilize the baseball 20 for learning to throw a circle change up, the ring finger of the left hand is placed on tactile surface 32 in the direction of the orange arrow 60. The fingertips of the thumb and index finger then meet so as to securely hold the ball 20 in the left hand.

Manufacturing of A Preferred Embodiment

A preferred method for constructing the baseball 20 incorporating tactile cues, substantially as described above, comprises modifying a standard baseball. However, as will readily be determined by one of skill in the art, the baseball 20 may be manufactured by any suitable method. Preferably, if commercial quantities of the baseball 20 are desired, construction of the baseballs 20 may be partially, or wholly, automated and the enlarged stitching 28, 30, 32, 34 will be provided during the initial manufacture, rather than by modification of existing conventional stitching.

In a preferred method, start by positioning the ball in front of you with the "horse-shoe" portion of the seam 24 and stitching 26 positioned with the ends of the "horseshoe" being directed up or away from you. Next, find the intersection of stitching that constitutes the center of the "horse-shoe." Mark the second, third and fourth stitches to the right of center with a pen (or other suitable marking utensil). Mark the second, third and fourth stitches to the left of center with the pen. At this point, there should be three stitches between the marked groups of stitches.

If a single handed baseball 20 is desired, then this is the point at which one must differentiate between the making of a right-handed ball or a left-handed ball. The following explanation will be for the manufacturing of a right handed ball. For a left handed ball, simply reverse the direction of progression from this point on.

Count three stitches from the left group of marked stitches. Mark the fourth, fifth and sixth stitches with the pen. Count another three stitches from the previous group of stitches and again mark the fourth, fifth and sixth stitches.

At this point apply an adhesive, such as an epoxy or glue, to all stitches immediately adjacent to the groups of marked stitches to keep them in place as you replace the marked stitches with a desired material to create the tactile surfaces. In a presently preferred embodiment, 100% cotton jewelry cord, such as DARICE brand jewelry cord (1.3 mm diameter) is used. However, as will be appreciated by one of skill in the art, other types of material or other material sizes may be used.

Once glue has dried, remove the marked stitching using a cutting instrument, such as a razor knife. Thread both ends of an 8-in. section of the jewelry cord into a sewing needle. To fit the string through the eye of the needle, the ends of the string can be unraveled. Begin stitching by pulling string through the first set of existing holes from the inside, out. Follow stitching pattern of ball till all open eyelets have been used. Cut the remaining string so that there is just enough length to tuck under the cover. Apply glue under the cover and tuck remaining string under cover. Repeat for each set of marked stitches. Upon completion, apply glue to each intersection of string.

For the creation of preferred finger placement indicia, once again orient the ball in front of you with the "horse-shoe" oriented so that it is open downward. From both tactile surfaces 28 and 30, draw a one inch green arrow 40, 42 at approximately a left 45 degree angle from the seam at the middle stitch toward the center of the "horse-shoe." These will be the indicators 40, 42 for the right-handed slider. From tactile surface 32 draw a one inch orange arrow 46 from the middle stitch, away from the inside of the "horse-shoe." This arrow should be perpendicular to the seam 24. This will be the indicator 46 for the right-handed circle change. From both tactile surfaces 32 and 34, draw a one inch red arrow 36, 38 from the middle stitch. These arrows should be perpendicular to the seam and point into the "horse-shoe." These will be the indicators 36, 38 for the right-handed four-seam fast ball. From the first stitch of tactile surface 32, draw a blue arrow 44 which runs parallel to the seam and terminates just past the last stitch of tactile surface 34 on the inside of the "horse-shoe." This arrow 44 should point towards the open end of the "horse-shoe" and will indicate for the right-handed curve ball. Of course, these arrows may be replaced by other markings, or other types of indicia, suitable to indicate a preferred finger placement.

A preferred embodiment of a baseball 20 providing tactile stimulation surfaces for teaching proper pitching releases for a variety of baseball pitches utilizing the principles of proprioceptive has been described above. Of course, modifications obvious to one of skill in the art are intended to be covered by the scope of the present invention. In addition, application of the proprioceptive trainer to a baseball is merely exemplary. Accordingly, it is intended that the invention not be limited by the embodiments described above, but that it be defined solely by the appended claims. The application of the tactile cues to create a proprioceptive trainer may also be used with other types of sporting balls, equipment and objects.

What is claimed is:

1. A training device, comprising:

a baseball defining an outer surface including a seam, said seam extending at least partially around said baseball, said baseball including a plurality of stitches extending across said seam;

a plurality of tactile surfaces, said tactile surfaces being raised above said outer surface of said baseball and configured to provide tactile stimulation to a user of said training device when grasping one or more of said plurality of tactile surfaces, said plurality of tactile surfaces being disposed on at least a portion of said plurality of stitches; and a plurality of finger placement indicia on said outer surface, said indicia being associated with said tactile surfaces and configured to indicate a finger placement orientation on one or more of said tactile surfaces relative to said baseball for at least four different types of baseball pitches;

wherein each of said plurality of tactile surfaces comprises one or more enlarged stitches.

2. The training device of claim 1, wherein each of said plurality of tactile surfaces comprises three consecutive enlarged stitches.

3. The training device of claim 1, wherein said enlarged stitches are comprised of a jewelry cord material.

4. The training device of claim 1, wherein each of said finger placement indicia comprises one or more arrows, said arrows being color-code to indicate a finger placement for each type of baseball pitch.

5. The training device of claim 1, wherein said four types of baseball pitches comprise a slider, a curve ball, a four-seam fastball and a circle change.

6. A training device, comprising:

a baseball defining an outer surface including a seam, said seam extending at least partially around said baseball, said baseball including a plurality of stitches extending across said seam;

at least two tactile surfaces, said tactile surfaces being raised above said outer surface of said baseball and configured to provide tactile stimulation to a user of said training device when grasping one or more of said tactile surfaces, each of said tactile surfaces being sized and shaped to conform generally to a fingertip of a user of said training device;

wherein each of said plurality of tactile surfaces comprises one or more enlarged stitches.

7. The training device of claim 6, wherein each of said plurality of tactile surfaces comprises three consecutive enlarged stitches.

8. The training device of claim 7, wherein said enlarged stitches are comprised of a jewelry cord material.

9. The training device of claim 6, additionally comprising at least two finger placement indicia on said outer surface, said indicia being associated with said tactile surfaces and configured to indicate a finger placement orientation on one or more of said tactile surfaces relative to said baseball for at least two types of baseball pitches.

10. The training device of claim 9, wherein each of said finger placement indicia comprises one or more arrows, said arrows being color-code to indicate a finger placement for each type of baseball pitches.

11. The training device of claim 9, wherein each of said finger placement indicia comprises one or more arrows, said arrows being color-code to indicate a finger placement for each type of pitch.

12. A training device comprising:

a baseball defining a seam, said seam extending at least partially around the baseball, said baseball including a plurality of stitches extending across the seam;

a protruding tactile surface on the outer surface of the baseball, the tactile surface indicating a location for finger placement;

further comprising a plurality of stitched tactile surfaces defining a set of tactile surfaces, the set of tactile surface corresponding to finger placements for throwing a pitch.

13. The training device of claim 12, wherein said tactile surface comprises a stitching of a jewelry cord material located along the stitching of the baseball.

14. The training device of claim 12, further comprising of a plurality of protruding tactile surfaces, the plurality of tactile surfaces indicating a plurality of finger placements for gripping the baseball for a pitch.

15. The training device of claim 12, wherein the tactile surface in communication to a user through tactile stimulation for improved proprioception for the release of the baseball.

16. The training device of claim 12, further comprising a marking on the surface of the baseball indicating the tactile surface corresponds to a pitch, wherein the pitch is one of a slider a slider, curve ball, four-seam fast ball, and circle change pitch.

17. The training device of claim 16, wherein the marking indicates an orientation for a finger of the user.

18. The training device of claim 14, where the pitch is a slider, curve ball, four-seam fast ball, or circle change pitch.

* * * * *